United States Patent [19]

Haas et al.

[11] 3,971,515

[45] July 27, 1976

[54] BALL MILL WITH ENERGIZING BODY ON THE WEARING PLATE

[75] Inventors: Helmut Haas, Proz-Wahn; Manfred Wolf, Lohmar, both of Germany

[73] Assignee: Klockner-Humboldt-Deutz Aktiengesellschaft, Germany

[22] Filed: Dec. 12, 1973

(Under Rule 47)

[21] Appl. No.: 426,635

[30] Foreign Application Priority Data

Dec. 13, 1972 Germany ..... 2260830

[52] U.S. Cl. ..... 241/175; 241/182

[51] Int. Cl.[2] ..... B02C 17/14; B02C 17/22

[58] Field of Search ..... 241/170, 172, 175, 182, 241/284

[56] References Cited

UNITED STATES PATENTS

| | | | |
|---|---|---|---|
| 1,590,655 | 6/1926 | Spicer | 241/182 |
| 3,310,245 | 3/1967 | Decker et al. | 241/175 |
| 3,701,487 | 10/1972 | Quesnel et al. | 241/182 |
| 3,844,492 | 10/1974 | Smallwood et al. | 241/182 |

FOREIGN PATENTS OR APPLICATIONS

| | | | |
|---|---|---|---|
| 2,006,789 | 8/1971 | Germany | 241/175 |

*Primary Examiner*—Granville Y. Custer, Jr.
*Assistant Examiner*—Howard N. Goldberg
*Attorney, Agent, or Firm*—Hill, Gross, Simpson, Van Santen, Steadman, Chiara & Simpson

[57] ABSTRACT

A ball mill having a wall forming a hollow tubular grinding chamber therein with balls or rods within the chamber and means for driving the chamber in a vibratory grinding motion with a fixed body in the form of an elongate shaft within the chamber supported on a tubular wearing plate having a gap along one side and springing outwardly to support itself firmly within the grinding chamber and having arms extending between the wearing plate and the fixed shaft for supporting the shaft and a removable end for the grinding chamber so that the shaft and wearing plate can be removed for replacement from the grinding chamber.

4 Claims, 4 Drawing Figures

BALL MILL WITH ENERGIZING BODY ON THE WEARING PLATE

BACKGROUND OF THE INVENTION

1. Field of the Invention

This invention relates to a ball mill with a grinding chamber partially filled with grinding bodies and lined with a wearing plate with a fixed body in the form of a shaft extending in the direction of the axis of the tubular chamber and supported by radial arms distributed in a longitudinal direction and supported on the wearing plate which is in turn supported within the wall of the grinding chamber. The structure relates to structures of the type shown in the copending patent application, Ser. No. 212,326, Filed Dec. 27, 1971, Now U.S. Pat. No. 3,838,825.

2. Description of the Prior Art

The term ball mills as used herein refers generally to vibratory driven mills which have movable bodies such as balls or rods therein that affect grinding by impacting the material between the movable bodies or between the bodies and the wall of the grinding chamber. In ball mills, the comminution or grinding effect greatly decreases inwardly from the outer wall on account of the damping which occurs to the movable bodies by means of the grinding material. Therefore, with larger grinding containers, the comminution output becomes unsatisfactory and with increased volume, the grinding effect diminishes. It has, therefore, been arranged to provide a fixed body in the form of a center shaft or pipe in the grinding container to shorten the distance between each of the movable bodies and a fixed body. In a tubular shaped grinding container, the center fixed axis is extended parallel to the axis of tubular container.

With this construction, it was possible to transfer the vibrating movement of the grinding container so that it affected the grinding material lying some distance from the wall of the chamber with equal intensity to that lying against the wall.

However, such shafts or pipes have been welded or secured to the ends of the tubular grinding chamber. With operation, the connections failed, and the shafts tore off of their mounts because of the large stresses incurred in operation after a short time.

From the German laid open Specification No. 2,006,789, constructions for fixed bodies, also known as energization bodies, within the grinding chamber are known. These fixed bodies are fixedly connected through supporting elements or directly on the wall of the grinding chamber, generally the end walls, or are pushed loosely into the grinding pipe or shaft so that support takes place through the supporting elements which are arranged in at least two planes perpendicular to the longitudinal axis of the energizing body. In the case of materials difficult to grind, high accelerating forces are necessary for the introduction of a sufficient amount of comminution energy into the movable grinding bodies that satisfactory and reliable fastenings have been considered too expensive for construction.

SUMMARY OF THE INVENTION

The problem which is being solved and which has served as the basis for the invention is to improve the arrangement of the fixed bodies, also called energizing bodies, in the grinding container obtaining more secure and reliable support and obtaining the advantage of easy replacement and exchangability of the fixed body. In accordance with the principles of the present invention, this is solved by supporting the fixed body in a fixed manner on the wearing plate. A wearing plate is positioned within the tubular body which springs outwardly against the tubular grinding chamber and holds itself fixedly in place. The supporting elements provide a unit with the wearing plate and support the fixed body within the grinding chamber thereon. Three elements within the grinding chamber are constructed as a unit, the energizing body, the wearing plate, and the supporting elements, and inasmuch as these elements wear relatively uniformly, they are replaced simultaneously. This results in a simplified and improved and less expensive unit in construction and one which is reliable in operation without the tearing loose of the fixed body during operation.

Accordingly, an object of the present invention is to provide an improved grinding mill construction which is capable of use in larger mills than heretofore possible and which is constructed so that the parts may be easily and readily replaced after wear.

Other objects and advantages will become more apparent, as will equivalent constructions which are intended to be covered herein, with the teaching of the principles of the invention in connection with the disclosure of the preferred embodiment in the specification, claims, and drawings, in which:

DESCRIPTION OF THE PREFERRED EMBODIMENTS

Figure 1:
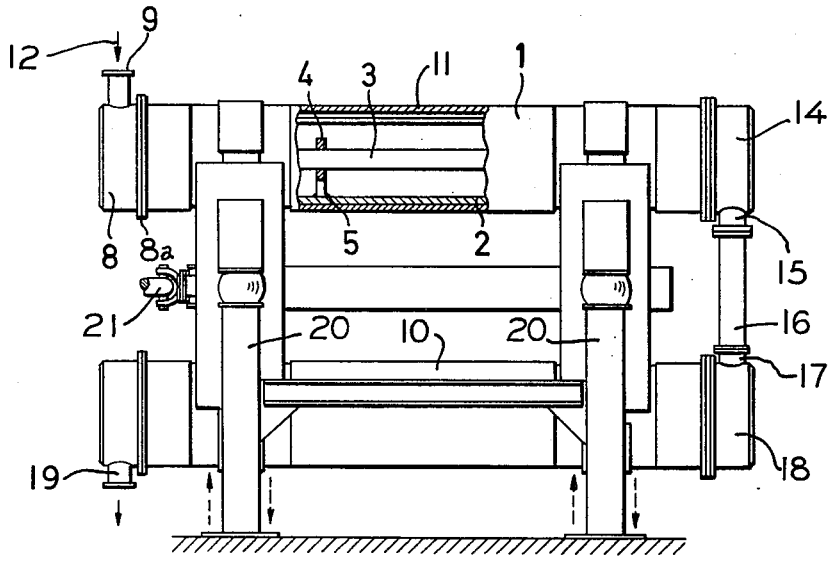
FIG. 1 is a somewhat schematic elevational view of a ball mill having two grinding containers with one of the containers partially in section.

FIG. 1 illustrates a ball mill with two tubular shaped grinding containers 1 and 10. These containers may be substantially identical in construction and, therefore, reference to detail need only be made with respect to the upper grinding container 1.

The upper grinding container is shown containing a tubular shaped wearing plate 2 having a fixed or energizing body 3 therein in the form of an elongate shaft extending coaxial with the chamber 1. The chamber 1 is hollow formed of a cylindrically shaped outer wall 11.

At the lead end of the chamber is an inlet head 8 which is removable and is provided with an upper inlet 9 for receiving material as indicated by the arrowed line 12. The head 8 is provided with a connecting flange **8*a* and is removable so as to leave an opening of the full cross-sectional size of the wall 11 of the grinding chamber 1. As will later become clear, removal of the head 8 will permit axial removal of the wear plate 2 and the stationary body 3** supported thereon.

Figure 2:
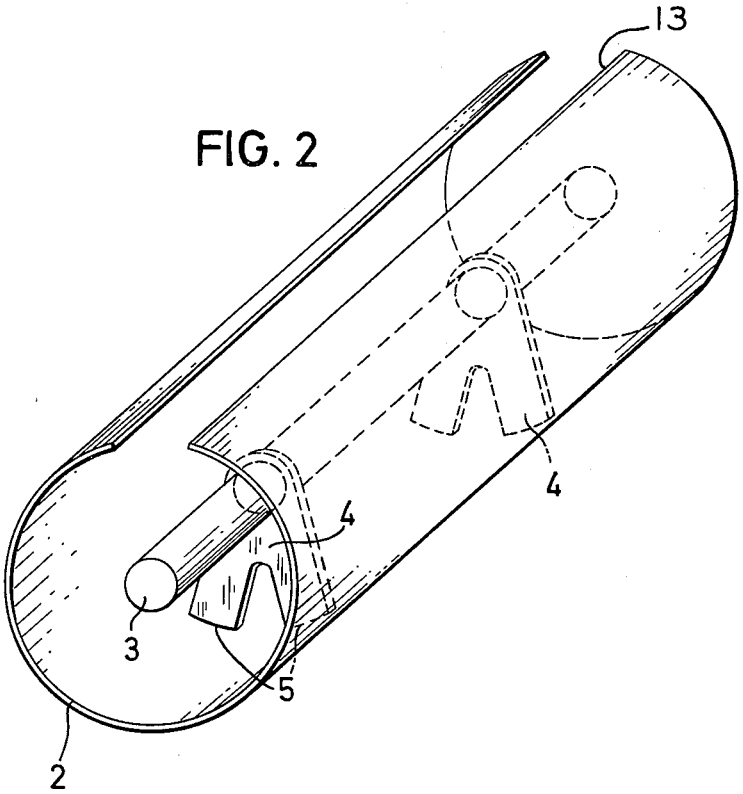
FIG. 2 is a fragmentary perspective view of a wearing plate removed from the grinding container.
Figure 3:
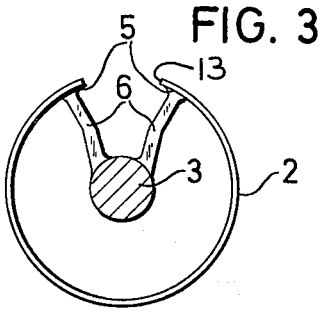
FIG. 3 is a end elevational view of a wearing plate illustrating one construction of supporting element.
Figure 4:
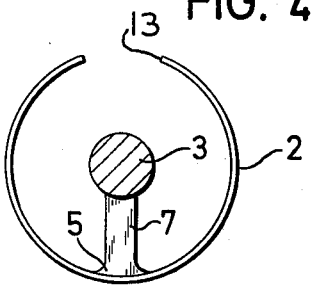
FIG. 4 is an end elevation of a wearing plate showing another construction.

The wearing plate 2 is constructed of an approximately cylindrical shaped sheet metal plate having an elongate gap 13 along one side, FIGS. 2 through 4. The plates are tubular in shape so as to conform substantially to the inner surface of the wall 11 of the grinding chamber. The plates have a natural spring bias so that they must be compressed radially inwardly for inserting them into the grinding chamber, so that when they are released, they spring outwardly firmly to make locking contact with the inner surface of the grinding chamber. Compression of the wear plates for interchanging the plates after they have become worn is accomplished by a suitable tool which pulls the edges of the gap together to compress the tubular wear plate and slide it axially relative to the grinding chamber. The inner surface of the tube thus provides a wearing surface which may be replaced, making it unnecessary to replace the chamber with wear.

As shown in FIG. 1, at the right end of the grinding chamber, is a head 14 with an outlet 15 leading down to the lower grinding chamber 10. A tube 16 connects to an inlet 17 of a head 18 for the lower grinding chamber, and when the material passes axially through the lower grinding chamber, it is discharged through an outlet 19 at the opposite end of the lower chamber.

The chambers are suitably resiliently mounted in a stand 20 and a power drive mechanism shown generally at 21 drives the chambers to provide the vibratory motion therein. Movable bodies such as balls are positioned within each of the chambers (not shown) to effect the comminuting operation in a manner which is well known to those versed in the art.

The wearing plate 2 is indicated as being continuous within the sectioned portion of FIG. 1, but it will be understood that it may be arranged in several axial lengths so that several wearing plates are inserted consecutively end-wise into the grinding chamber. In these arrangements, the fixed shaft 3 will be also in sections.

In the arrangement of FIG. 2, the fixed shaft 3 is supported coaxially within the wearing plate 2 on forked arms 4 which are axially spaced from each other. At the outer ends of the arms 5, they are fixedly secured to the inner surface of the wear plate. The location of the connecting point 5 may be at any desired location so long as the ends do not cover the gap 13 at one side of the wear plate.

FIG. 3 shows another embodiment wherein the supporting arms are in the form of radial struts 6 constructed so as to be capable of resiliently bending. The arms 6 are resilient and are biased in a direction so as to urge the wear plate more firmly within the chamber. Or, the arms may merely be resilient and not biased and constructed to accommodate bending of the wear plate when it is drawn together to be removed from the chamber. When the arms join the wear plate at a location adjacent the slot 13, it is essential that they be resilient so as to accommodate circumferential contraction of the wear plate when it is inserted or removed into the chamber. When the arms are extending toward the wear plate opposite the slot, as in the manner in FIG. 2, they need not be resilient.

In the arrangement of FIG. 4, a single arm 7 is shown having a connecting point 5 to secure it to the inner surface of the wear plate 2. Again, the arm 7 provides a support for the stationary shaft 3 at its central axial location within the wear plate.

We claim:

1. A vibratory mill having a chamber for containing movable grinding bodies therein comprising:

a wall forming a grinding chamber;

means for driving the chamber in a vibratory grinding motion;

a fixed body within the chamber spaced from the wall;

a wearing plate within the wall on the inner surface of the chamber shaped to conform to the inner surface of the grinding chamber and being resilient and biased outwardly against the inner surface of the wall for holding its position therein;

and means supporting said body on said wearing plate.

2. A vibratory mill having a chamber for containing movable grinding bodies therein comprising:

a wall forming a grinding chamber tubular in shape;

means for driving the chamber in a vibratory grinding motion;

a fixed body within the chamber spaced from the wall;

a wearing plate within the wall on the inner surface of the chamber with the wearing plate being tubular and having an axially extending gap along one side;

means supporting said body on said wearing plate;

and said support means being in the form of radially extending elements biased in a direction to urge the wearing plate against the inner surface of the grinding chamber wall.

3. A vibratory mill having a chamber for containing movable grinding bodies therein comprising:

a wall forming a grinding chamber tubular in shape;

means for driving the chamber in a vibratory grinding motion;

a fixed body within the chamber spaced from the wall;

a wearing plate within the wall on the inner surface of the chamber and said wearing plate being tubular with a gap extending axially along one side;

means supporting said body on said wearing plate;

and said supporting means being in the form of separated arms extending between the wearing plate and the fixed body at spaced axial locations.

4. A vibratory mill having a chamber for containing movable grinding bodies therein comprising:

a wall forming a grinding chamber tubular in shape;

means for driving the chamber in a vibratory grinding motion;

a fixed body within the chamber spaced from the wall;

a wearing plate within the wall on the inner surface of the chamber being tubular shaped to conform to the inner surface of the grinding chamber and having an axially extending slot along one side and being biased radially outwardly against the inner wall of the grinding chamber;

said chamber having a removable end so that the wearing plate and fixed body supported thereon may be be removed through said end;

and means supporting said body on said wearing plate.

* * * * *